US007765756B2

(12) United States Patent
Bontrager, II

(10) Patent No.: US 7,765,756 B2
(45) Date of Patent: Aug. 3, 2010

(54) LOW NOISE ROOF DECK SYSTEM

(76) Inventor: Arley L. Bontrager, II, 12716 Wenonga La., Leawood, KS (US) 66209

( * ) Notice: Subject to any disclaimer, the term of this patent is extended or adjusted under 35 U.S.C. 154(b) by 469 days.

(21) Appl. No.: 11/067,172

(22) Filed: Feb. 25, 2005

(65) Prior Publication Data

US 2006/0191223 A1 Aug. 31, 2006

(51) Int. Cl.
*E04B 7/00* (2006.01)
*E04D 11/02* (2006.01)

(52) U.S. Cl. ..... 52/410; 52/309.8; 52/309.14; 52/794.1; 52/746.11; 428/316.6

(58) Field of Classification Search ..... 52/410, 52/408, 411, 409, 309.14, 309.8, 794.1, 746.11; 428/319.3, 319.7, 316.6
See application file for complete search history.

(56) References Cited

U.S. PATENT DOCUMENTS 3,095,671 A 7/1963 Fink et al.
3,111,787 A * 11/1963 Chamberlain ..... 52/309.9
3,411,256 A * 11/1968 Best ..... 52/408
3,965,633 A 6/1976 Carroll
4,078,349 A 3/1978 Gantner
4,389,826 A * 6/1983 Kelly ..... 52/410
4,441,295 A * 4/1984 Kelly ..... 52/408
4,559,263 A 12/1985 Roodvoets
4,564,554 A 1/1986 Mikuski
4,587,164 A 5/1986 Freeman
4,601,151 A 7/1986 Nunley et al.
4,702,046 A 10/1987 Haugen et al.
4,707,961 A * 11/1987 Nunley et al. ..... 52/408
4,736,561 A 4/1988 Lehr et al.
4,783,942 A 11/1988 Nunley et al.
4,852,314 A 8/1989 Moore, Jr.
4,937,990 A 7/1990 Paquette
5,031,374 A * 7/1991 Batch et al. ..... 52/410
5,088,259 A * 2/1992 Myers ..... 52/410
5,253,461 A * 10/1993 Janoski et al. ..... 52/408

(Continued)

OTHER PUBLICATIONS

Tectum Inc., Roof Deck & Form Systems, Jan. 2003, p. 2-3.*

(Continued)

*Primary Examiner*—Robert J Canfield
*Assistant Examiner*—Jessie Fonseca
(74) *Attorney, Agent, or Firm*—Polsinelli Shughart PC; Marcia J. Rodgers; David J. McCrosky

(57) ABSTRACT

A low noise roof deck system eliminates the thermal expansion noises associated with metal decking and includes structural features that permit installation of composite roofing shingles directly over the deck without venting. The system includes a composite panel base layer surmounted by a layer of water resistant material, a layer of foam synthetic resin insulation and a layer of mineral board. A second layer of mineral board may be overlaid on the first mineral board layer. The system is easily installed over a system of conventional underlying supports to provide a strong, rigid deck for supporting a waterproof composite shingle roof membrane and forming a quiet weatherproof roof system. The composite base panel has a layer of synthetic resin foam insulation sandwiched between a base layer of wood fibers bonded with an inorganic cement and an upper layer of a resin bonded wood product.

18 Claims, 8 Drawing Sheets

U.S. PATENT DOCUMENTS

| | | | | | |
|---|---|---|---|---|---|
| 5,406,765 | A | | 4/1995 | Brown | |
| 5,433,050 | A | | 7/1995 | Wilson et al. | |
| 5,473,847 | A | * | 12/1995 | Crookston | 52/302.1 |
| 5,502,931 | A | | 4/1996 | Munir | |
| 5,557,896 | A | | 9/1996 | Imeokparia et al. | |
| 5,584,153 | A | | 12/1996 | Nunley et al. | |
| 5,644,880 | A | | 7/1997 | Lehnert et al. | |
| 5,740,647 | A | * | 4/1998 | Kelly | 52/408 |
| 5,784,845 | A | | 7/1998 | Imeokparia et al. | |
| 5,784,846 | A | * | 7/1998 | Godschalx | 52/409 |
| 5,867,957 | A | | 2/1999 | Hotrop | |
| 6,088,992 | A | | 7/2000 | Nunley et al. | |
| 6,092,344 | A | * | 7/2000 | Kelly | 52/410 |
| 6,250,036 | B1 | | 6/2001 | Nunley et al. | |
| 6,279,293 | B1 | * | 8/2001 | Ojala | 52/794.1 |
| 6,308,491 | B1 | * | 10/2001 | Porter | 52/794.1 |
| 2003/0082365 | A1 | | 5/2003 | Geary et al. | |

OTHER PUBLICATIONS

Loadmaster Systems, Inc., Roof Deck Construction Systems, 2001, p. 2.*

Loadmaster Systems. Inc. Roof Deck Construction Systems, 2002. (www.archve.org).*

Tectum, Inc., Tectum Roof Deck Systems, Internet Site, www.tectum.com/roofdeck.htm.

Loadmaster Systems, Inc., Loadmaster Roof Deck Construction Systems, Internet Site www.loadmaster.net/archtectural_guide/engineeringadvancement.shtml.

Loadmaster Systems, Inc., Loadmaster Roof Deck Construction Systems, Internet Site www.loadmaster.net/archtectural_guide/shingleventing.shtml.

Loadmaster Systems, Inc., Loadmaster Roof Deck Construction Systems, Internet Site www.loadmaster.net/assemblyguide/index.shtml.

Loadmaster Systems, Inc., Loadmaster Roof Deck Construction Systems, Internet Site www.loadmaster.net/archtectural_guide/toc.shtml.

Loadmaster Systems, Inc., Loadmaster Roof Deck Construction Systems, Internet Site www.loadmaster.net/faq/doesitcontainwood.shtml.

Tectum Inc., Technical Bulletin, Diaphragm and Tectum Roof Decks, T-4. Rev. Jan. 2002, Newark, OH.

Tectum Inc., Technical Bulletin, Fully Adhered Single Ply Roofing Over Tecum Composite Roof Decks, T-66 Rev. Jun. 2000Newark, OH.

Tectum Inc., Technical Bulletin, Attaching Shingles to Tectum Roof Decks, T-30A Rev. Mar. 2002, Newark, OH.

ES Report, Tectum I, Tectum III and Tectum E Roof Deck Panels, ER-1116, Reisued Jul. 1, 2001, Whittier, CA.

Tectum Inc., Tectum Roof Deck Form System, Newark, OH.

Boca International Evaluation Services, Research Report 86-39 Printed Apr. 1989, Edictorial Revision May 1999, Country Club Hills, IL.

Wood Products Industry, Waferboard/Oriented Strandboard Manufacturing, 10.6.1-34, Mar. 2002.

SBCCI Public Safety Testing and Evaluation Services Inc., Report No. 9406B, Birmingham, AL.

Tectum Inc., Technical Bulletin, Comparing Noise Reduction Coefficients of Acoustical Steel Deck to Tectum Roof Deck Systems, T-67 Jan. 1994, Newark, OH.

Tectum Inc., Technical Bulletin, Comparing Tectum to Acoustical Steel Deck, T-12 Rev. Jan. 2003, Newark, OH.

Tectum Inc., Roof Deck Form Systems, 03500/TEC, BuyLine 1436, Newark, OH.

Loadmaster Systems, Inc., Roof Deck Construction Systems, Loadmaster's Noise Dampening System, Internet Site www.loadmaster.net/architectural_guide/noisedampening.shtml.

Tech Truss Tees, Truss Tee Subpurlins, 03500/TEB, Buyline 4645.

Loadmaster Systems, Inc., Roof Deck Systems.

* cited by examiner

LOW NOISE ROOF DECK SYSTEM

BACKGROUND OF THE INVENTION

The present invention is broadly concerned with an improved roof deck system for quiet buildings. More particularly, it is concerned with a multilaminate acoustical deck supporting an outer layer of roofing shingles without the need for a metal decking substrate or venting.

The roof of a building normally consists of a waterproof outer layer or membrane of roofing material installed over a supporting deck. Skeletal framing or support members are used to support the deck. The roof deck must be strong enough to support the roofing membrane material as well as any rain or snow load. The roof deck must also remain rigid despite cyclical changes in temperature and varying wind conditions, since any movement of the deck may cause buckling or tearing of the overlying roofing material.

Any of a number of materials may be employed as decking materials, including wood, concrete, gypsum and steel. Steel decking is one of the most common roof deck materials employed in structural steel or masonry framed buildings with open web steel joists. The popularity of steel decking may be attributed to its suitable characteristics with regard to live load, span, fire rating, compatibility with electrical and telephone circuits and ceiling materials, and its relatively low cost. Steel decking is generally available in the form of corrugated or ribbed panels or sheets that are usually attached to steel framing members by welding.

However, despite its many desirable characteristics, steel has a relatively high coefficient of thermal expansion when compared with some other roof substrate materials such as wood and gypsum. As the cycles of the sun increase and decrease the heat load, or the ambient temperature surrounding a building changes with weather and the seasons, steel decking expands and contracts in accordance with this thermal expansion coefficient. Wind and air pressure changes may also cause movement of the decking. Such movement is well known to generate noise. Manufacturers of roofing materials have identified a number of different loci of steel deck/roof structure movement that contribute to noise that can be heard inside a building: the exterior perimeter framing of the roof may move with respect to the steel deck; the deck may move with respect to the underlying steel bar joists; the ends and/or side laps of individual decking panels may move against each other; the deck may move against any of its fasteners; the deck may move with respect to any insulation that has been used; when thermal expansion of decking framed to rigid walls or framed into walls on an angle is added to axial compression loads, compressive flange buckling can result, and purlins in prefabricated structures may move.

Movement of the steel decking substrate of a roof can generate sharp loud noises such as hammering, banging, pops, creaks and booms. In addition, in large clear span structures, the roof deck functions as a diaphragm or sound board (tympanum) which serves to reverberate sounds into the building space below. The resulting noises are particularly undesirable in normally quiet building spaces such as libraries, schools, churches and chapels, auditoriums and theaters. These noises may also be disruptive at certain times in non-quiet building spaces such as gymnasiums, civic centers and arenas. Such noises have been known to substantially impair the utility of the affected building space. When that occurs, they give rise to disputes between builders and clients and may necessitate costly remedial measures.

Various attempts have been made to increase the sound-absorbing or dampening properties of steel decking. For example, steel decking has been fabricated to include perforated fins for receiving insulation. Rigid insulation board has been applied directly over the decking. Cellular steel decking has been fabricated to include perforated bottom panels that serve as a substrate for added insulation. So-called acoustical metal deck has been constructed with open sided flutes or perforations in the ribs or flutes. Noise gaskets have been employed to isolate the structural supports from the steel roof deck. Gaskets have also been employed to isolate the individual corrugated deck sheets at their overlapping side edges and overlapping or butting end joints, so that they do not contact the adjacent deck sheets. Sheets of sound dampening material have been inserted between the steel deck and the roof insulation. Batts of fiberglass insulation have been installed between the upper surface of acoustical ceilings and the lower surface of the steel decking. Termination supports have been modified to include perimeter expansion relief, and expansion runs have been limited to twenty feet. Steel drive pins and screws have also been used to replace welding of steel deck sheets to the underlying steel support structure.

None of these approaches has been entirely successful in eliminating steel roof deck noises in quiet buildings, and most add substantially to the cost of the affected construction project. It is possible to eliminate the steel roof deck entirely, but a substitute diaphragm must be provided. This diaphragm must be capable of meeting shear requirements by transferring horizontal wind and seismic loads to the shear walls as well as supporting the roofing membrane material. Wood ply panels by themselves are generally not well suited for use as a substrate for commercial buildings because wood is subject to shrinkage, swelling, warping, twisting, rotting and burning. Because wood ply panels are subject to movement, they also do not retain fasteners well. Composite roof deck systems are available that include a sound insulating material sandwiched between various wood-based substrates that are somewhat less subject to the problems associated with wood ply panels. Some of these systems are constructed without a metal decking substrate. In such systems, many of the loud noises attributable to thermal expansion load are eliminated. In addition, the insulating layer of such systems serves to dampen noise. Such systems are not weatherproof and are designed for use in association with a roofing membrane material that renders the roof impervious to the weather.

Composition shingles are a particularly favored roofing membrane material because they are relatively light weight, easy to install, durable and esthetically pleasing. They are a particularly economical choice for use in large, long span buildings. However, when composition shingles are applied over a wood-containing decking substrate, such as a composite roof deck system, it is necessary to provide venting underneath the shingles to prevent cracking or splitting of shingles and to maintain the decking in a dry condition. It is difficult to provide effective venting beneath shingles, and such venting is generally accomplished by constructing a series of venting channels and spacers between the decking substrate and the shingles. Because the open ends and empty spaces of the channels provide access to insects and nesting spaces for animals, screen covers are generally installed over the ends of the channels. Thus, the venting requirements for composite roof deck systems with wood based substrates make it difficult and expensive to install a composition shingle roofing membrane over currently available systems.

Consequently, there remains a need for a roof deck system that is suitable for use in quiet buildings, that does not require the use of a steel deck substrate, and that can accept a composite shingle membrane material without the need for a venting system.

SUMMARY OF THE INVENTION

The present invention provides a greatly improved low noise roof deck system that eliminates the thermal expansion noises associated with metal decking substrates and includes structural features that permit installation of composite roofing shingles directly over the deck without the need for venting. The system of the invention includes a composite base panel surmounted by a mineral board panel, with a layer of a substantially water resistant material disposed between them. The system is easily installed over a system of conventional underlying supports to provide a strong, rigid deck for supporting a waterproof membrane layer. The composite base panel has a layer of a foam synthetic resin insulation material sandwiched between a base layer of wood fibers bonded with an inorganic cement bonding material and an upper layer of a resin bonded wood product. An optional layer of a foam synthetic resin insulation material may be installed beneath the mineral board panel. A second mineral board panel may be overlaid on the first mineral board panel. A low noise roof system is installed by securing a composite base panel to an underlying roof support member. A layer of red rosin paper is installed over the composite base panel. A mineral board panel is installed over the red rosin paper. A layer of composite shingles is fastened over the mineral board to form a quiet, weatherproof roof system.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
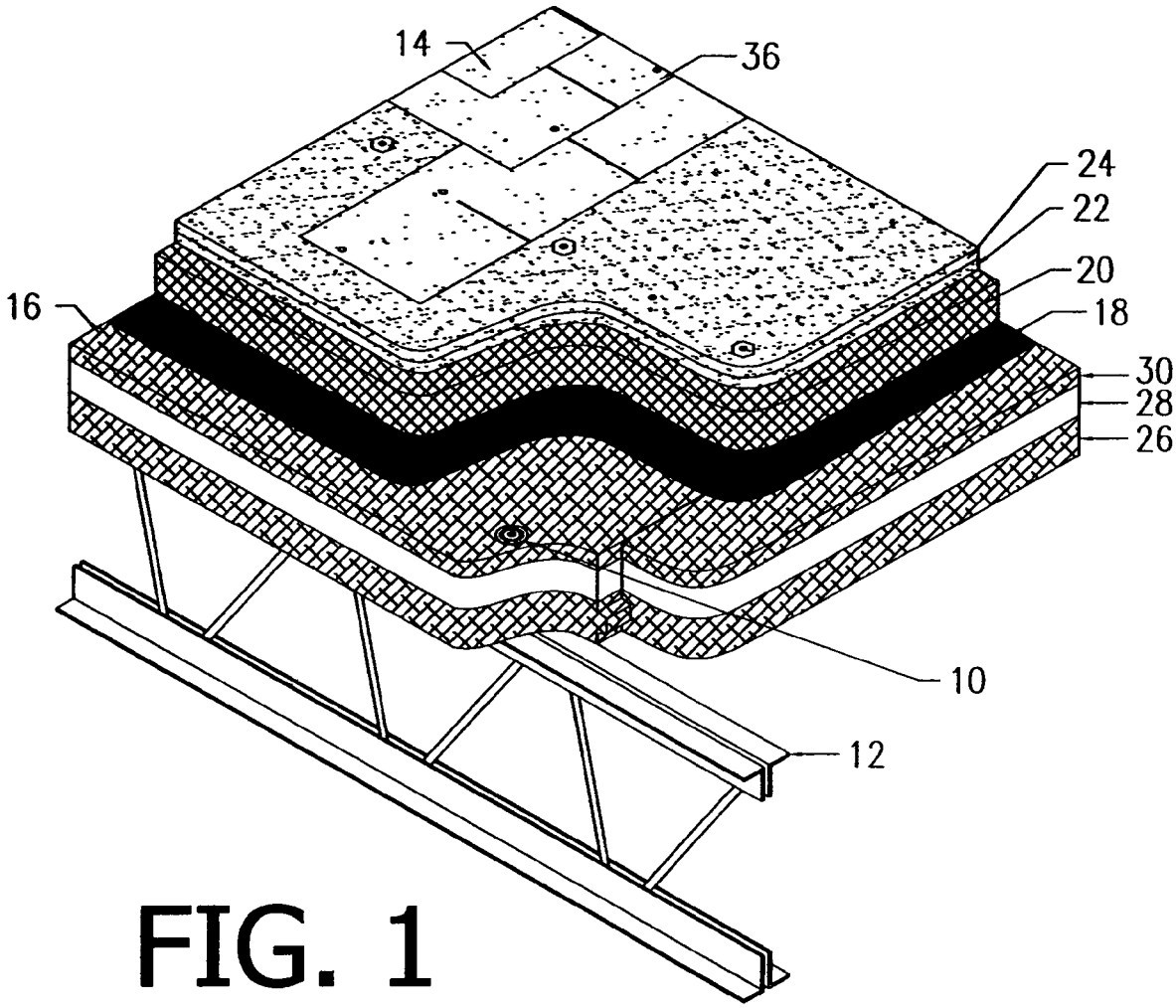
FIG. 1 is a perspective view of a portion of a low noise roof system in accordance with the present invention.

A low noise roof deck system in accordance with the present invention is generally designated by the reference numeral 10 and is illustrated in FIG. 1 in an exemplary installation in association with a plurality of roof support members 12 and an overlying waterproof roofing membrane 14. The support members 12 may include trusses, joists, beams, purlins, subpurlins or any other structural elements or suitable combination of elements fabricated from steel, which may be of open web construction such as bar joists, or from wood, which may be of unitary construction or multilaminate such as glue laminated supports, or masonry, such as concrete, stone or bricks. The roof deck system 10 broadly includes a base panel 16, a water resistant membrane 18, a layer of insulation 20 and a pair of mineral board panel layers 22 and 24.

The composite base panel 16 is of multilaminate construction and includes a first, normally lower layer 26 constructed of wood-cement board, a second, intermediate layer of a foam synthetic resin insulation material 28 bonded to the first layer, and a third, normally upper layer of resin bonded wood product or material 30 that is bonded to the second layer. The lower layer 26 may be of cement board constructed of wood fibers in combination with noncombustible mineral cements to be strong and fire resistant. Alternatively, the lower layer 26 may be constructed of oriented strand or chip board, gypsum or plywood. One such structural wood cement board product 26 is sold under the trademark Tectum™ by Tectum, Inc. This wood cement board product is manufactured from a mixture of long wood fibers or excelsior bonded with inorganic hydraulic cement binders which may include magnesium oxide, magnesium sulfate, magnesium oxysulfate, sodium silicate, calcium carbonate and various combinations thereof. The mixture is continuously formed under heat and pressure into elongated planks, panels or tiles that may be sprayed or otherwise treated with a silicone composition to resist water and water migration.

Those skilled in the art will appreciate that other types of cement board products, particularly those employing portland cement and/or glass and carbon fiber or other organic fibers such as polypropylene, could also be employed. Other manufacturers of cement board products employ a proprietary wax emulsion composition to impart water resistance. While cement board planks having a thickness of from about 1½ to about 3 inches are particularly preferred for use in the first layer 24, planks, panels and tiles of other suitable thicknesses, such as, for example about ½ inch to about one inch may also be employed.

The second layer of synthetic resin foam insulating material 28 provides thermal resistance (R value) and compressive strength and also serves as a water vapor retarder. While any of a number of forms of insulation may be used, Expanded Polymerized Styrene (polystyrene, or EPS) is particularly well-suited for use because of its high flexural strength. EPS is commercially available under the trademarks STYROFOAM® from the Dow Chemical Company and Foamular® from U.D. Industries, Inc. It is foreseen that polyisocyanurate foam insulation could also be employed, as well as alkenyl aromatic polymer foam, polyurethane, phenol based insulations, fiberglass, cork and combinations thereof. The foam insulation layer has a thickness of from about ½ inch to about 12 inches, although a thickness of about 2 inches is particularly preferred.

The third layer 30 provides a nailable surface and is constructed of a resin bonded wood material such as waferboard or oriented strand board (OSB) sheathing. Such sheathing is formed of wood wafers or strands bonded under heat and pressure with a waterproof phenolic resin compound. The surface is treated with a non-slip composition to provide improved traction for workers when the sheathing is installed on a slope. A code recognized OSB sheathing having a thickness of about 7/16 inches is preferred, although thicker sheathing may also be employed for longer spans. It is also foreseen that any code recognized sheathing material such as ½ inch plywood or gypsum could also be employed.

The three layers 26, 28, and 30 are bonded together using a moisture resistant structural grade laminating adhesive, such as a urethane-based adhesive to form a modular composite base panel 16. The panel 16 is generally rectangular in shape and has a thickness of from about 2 15/16 inches to about 13 15/16 inches, with a preferred thickness of about 3 15/16 inches. Commercially available panels have a width of up to about 48 inches and a length of up to about 192 inches. It is foreseen that the long edges of the first or cement board layer 24 may be constructed to include tongues, grooves or rabbets in order to facilitate mating engagement of adjacent panels.

The substantially water resistant separator, slip sheet or buffer membrane 18 is a roofing type substrate layer such as, for example a ply of 30 pound roofing felt or red rosin paper. It is foreseen that a synthetic resin material or any other suitable waterproof substance could also be employed to form this membrane.

The insulation layer 20 is a synthetic resin foam insulation material that resists moisture damage and provides thermal resistance. A foam synthetic resin material such as polyisocyanurate or EPS is particularly preferred, although other suitable insulation materials such as alkenyl aromatic polymer foam, polyurethane, phenol based insulations, fiberglass, cork and combinations thereof may also be employed. Depending on the environmental conditions and the purpose of the building, the foam layer may have a thickness of up to about 10 inches, with a thickness of about 2 inches being particularly preferred.

The panels or layers of inorganic mineral board 22 and 24 are dimensionally stable and heat absorbent. One such mineral board product is sold under the trademark Duraflex™ by Loadmaster Systems, Inc. This product is manufactured from inorganic components such as gypsum reinforced with fiberglass. It is foreseen that gypsum panels may also be employed. While panels having a thickness of from about ½ inch to about 1½ inch are preferred, with a thickness of about ⅓ inch to about ⅝ inch being especially preferred, any other suitable thickness may also be employed. The longitudinal edges of the panels may include tongues and grooves or rabbets to permit interlocking engagement to form a substantially continuous roof system.

Figure 2:
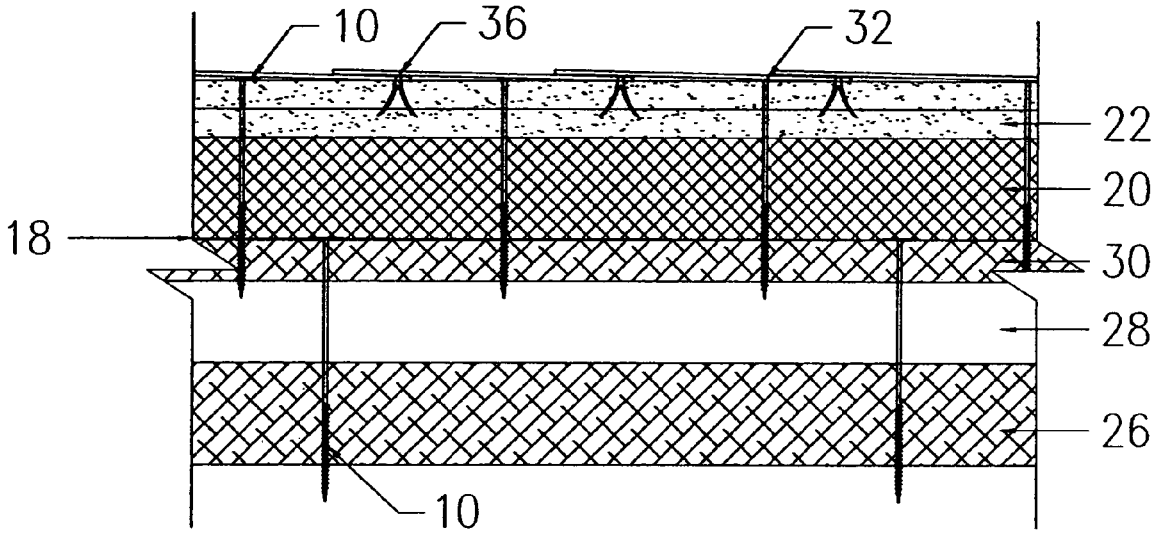
FIG. 2 is a cross sectional view of the system shown in FIG. 1.

The second mineral board panel layer 24, first mineral board panel layer 22 and insulation layer 20 are fastened together and to the third or oriented strand board layer 30 of the base panel 16 with fasteners such as mineral board screws 32 (FIG. 2), which are installed through compression discs (not shown). The screws 32 may also extend downwardly into the second or insulating layer 28 or the base panel 16.

The waterproof roof membrane 14 is constructed of a plurality of composition asphalt shingles 36 installed in overlapping relation. It is also foreseen that a built up roof, modified bitumen or EPDM or TPO single ply or metal standing seam, clay or concrete or steel tiles could be substituted for the shingles 36. The shingles 36 are installed using fasteners 38. One such fastener, sold under the trademark Do-all Lock nails, includes a pair of legs that splay outwardly upon application of a driving force to lock the shingles 36 in place on the underlying substrate.

In use, a worker installs the low noise roof deck system 10 by positioning a composite base panel 16 with the wood-cement board first layer 26 in a downward facing orientation and the OSB third layer 30 in an upward facing orientation. The worker next secures each panel 16 to the underlying roof support member, such as a truss type subpurlin 12 using construction glue and screw type fasteners 32 driven downwardly through the third or OSB layer 30 and into the top surface of the support 12. A plurality of base panels 16 are installed side-by-side and end-to-end in this manner, with any tongue and groove or rabbet edges aligned and matingly engaged. The substantially moisture resistant membrane 18 is overlaid, and may be secured in place by roofing staples driven into the upper OSB layer 30. The membrane 18 is overlaid with insulation panels 20, which in turn are overlaid by first and second mineral board panels 22 and 24. The worker next secures the mineral board panels 24 and underlying mineral board panels 22 and insulation layer 20 to the base panel 16 using mineral board screws 32 driven downwardly through the compression discs and into the OSB layer 30 of the base panel 16. The shingles 36 are installed in overlying relation to the mineral board layer 24 in the conventional overlapping manner with staggered joints using the fasteners 38.

Figure 3:
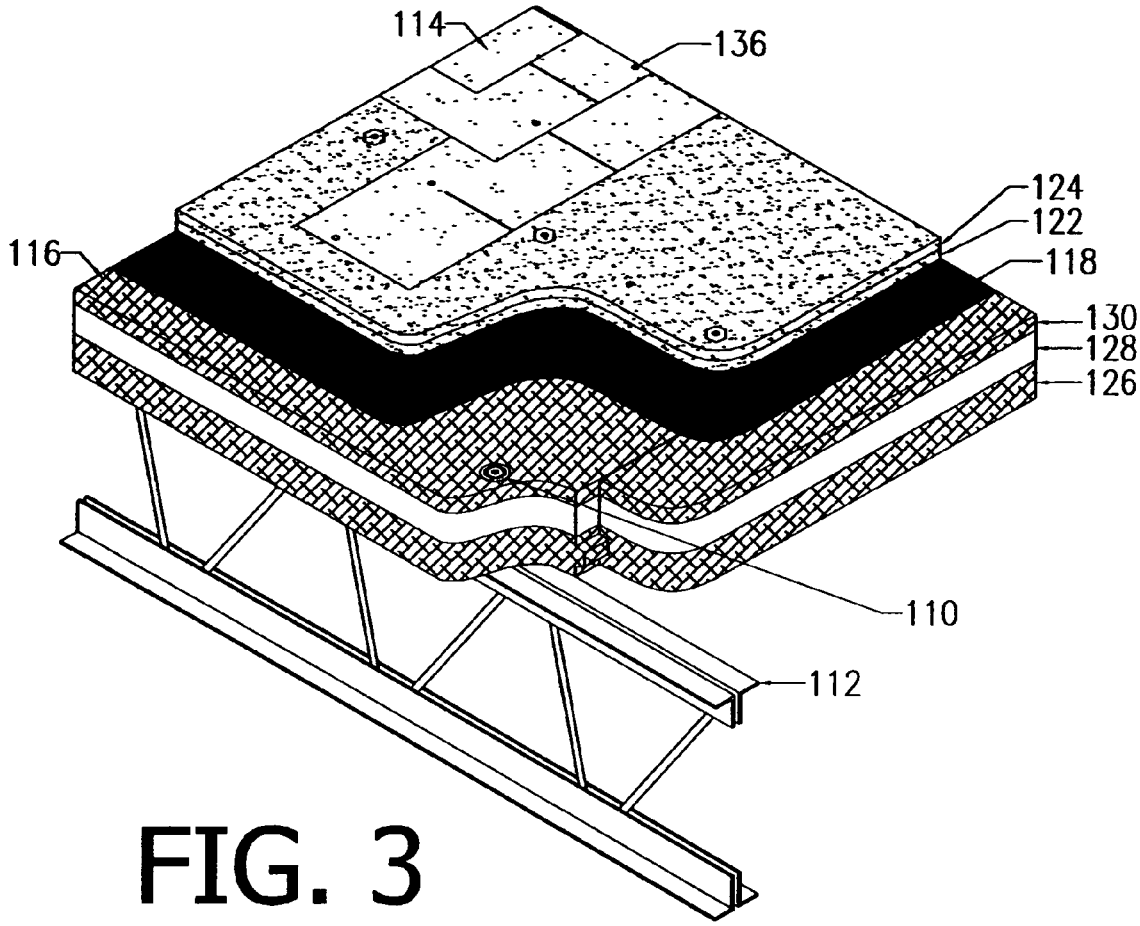
FIG. 3 is a perspective view of a second embodiment of the system shown in FIG. 1, showing the mineral board layers resting directly on the red rosin paper.
Figure 4:
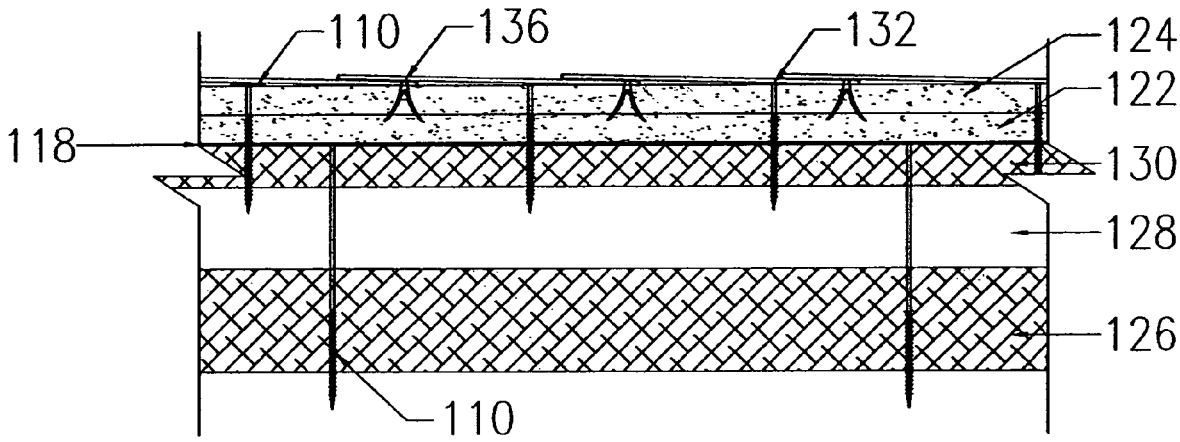
FIG. 4 is a cross sectional view of the system shown in FIG. 3.

A first alternate embodiment of a roof deck system 110 is shown in FIGS. 3 and 4 in an environment substantially identical to that previously described. The system 110 includes a similar base panel 116 surmounted by a substantially water resistant membrane 118 as previously described, and first and second mineral board layers 122 and 124. The base panel 116 includes layers 126, 128, and 130 similar to layers 26, 28, and 30 of the base panel of the roof deck system 10. The mineral board layer 122 rests directly on the red rosin paper 118. As with the first embodiment described herein, no metal roofing substrate panels are employed, and their attendant noises are eliminated. Thus, the insulation layer 128 of the base panel 116 in conjunction with the other layers of the base panel 116 and the mineral board layers 122 and 124 provides sufficient sound insulation for a quiet building. The cost of the roof deck system 110 is somewhat less and the installation is somewhat faster because there is no insulation layer between the rosin paper 118 and the first mineral board layer 122.

In use, this roof deck system 110 is installed on roof supports 112 substantially as previously described, except that somewhat shorter mineral board screws 132 may be employed, and they may extend farther into the insulation layer 128 of the base panel 116. The illustrated deck system 110 is covered by a waterproof membrane 114, such as shingles 136, in a manner similar to the deck system 10.

Figure 5:
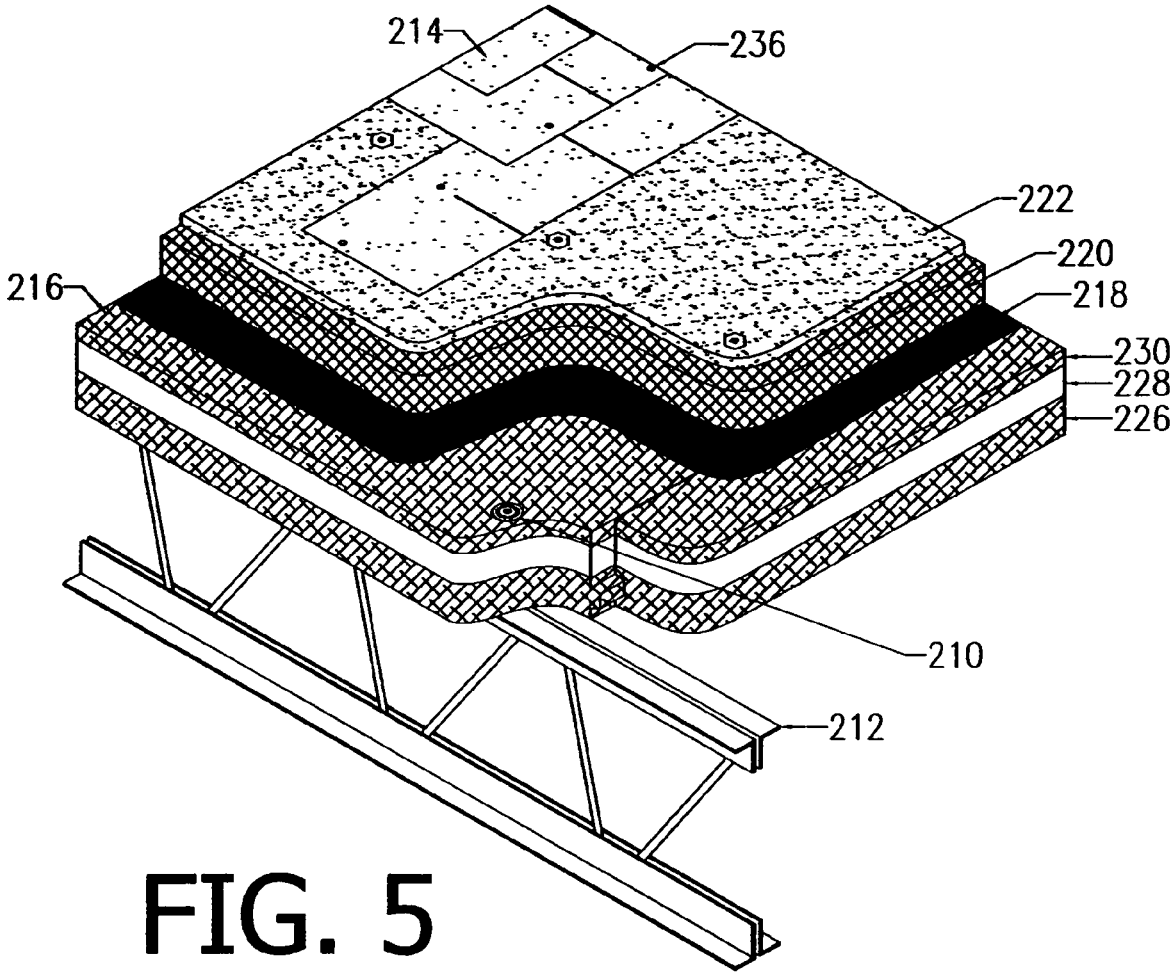
FIG. 5 is a perspective view of a third embodiment of the system shown in FIG. 1, showing a single layer of mineral board installed over a layer of insulation material.
Figure 6:
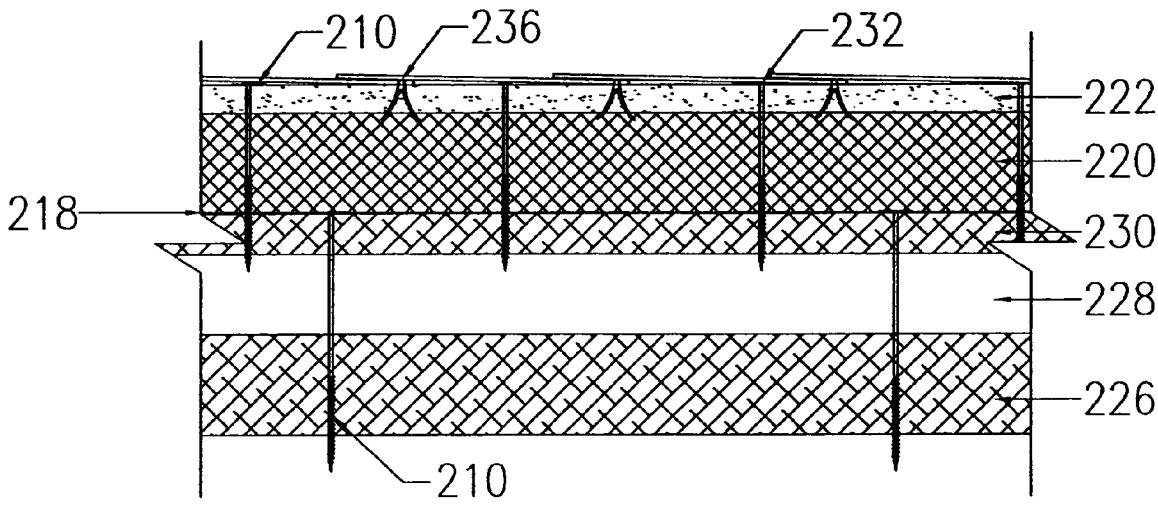
FIG. 6 is a cross sectional view of the system shown in FIG. 5.

A second alternate embodiment of a roof deck system 210 is shown in FIGS. 5 and 6 to include a similar base panel 216 surmounted by a substantially water resistant membrane 218 as previously described, a layer of synthetic resin foam insulation 220 and a mineral board layer 222. Only a single layer of mineral board 222 is employed. The base panel 216 includes panels 226, 228, and 230 similar to layers 26, 28, and 30 of the base panel 16 of the roof deck system 10. The roof deck system 210 is supported on roof support members 212 and is covered by a waterproof membrane 214, formed on shingles 236, similar to the membrane 14 of the system 10. The illustrated foam insulation 220 and mineral board layer 222 are secured to the base panel 216 by mineral board screws 232, similar to the roof deck system 10.

Figure 7:
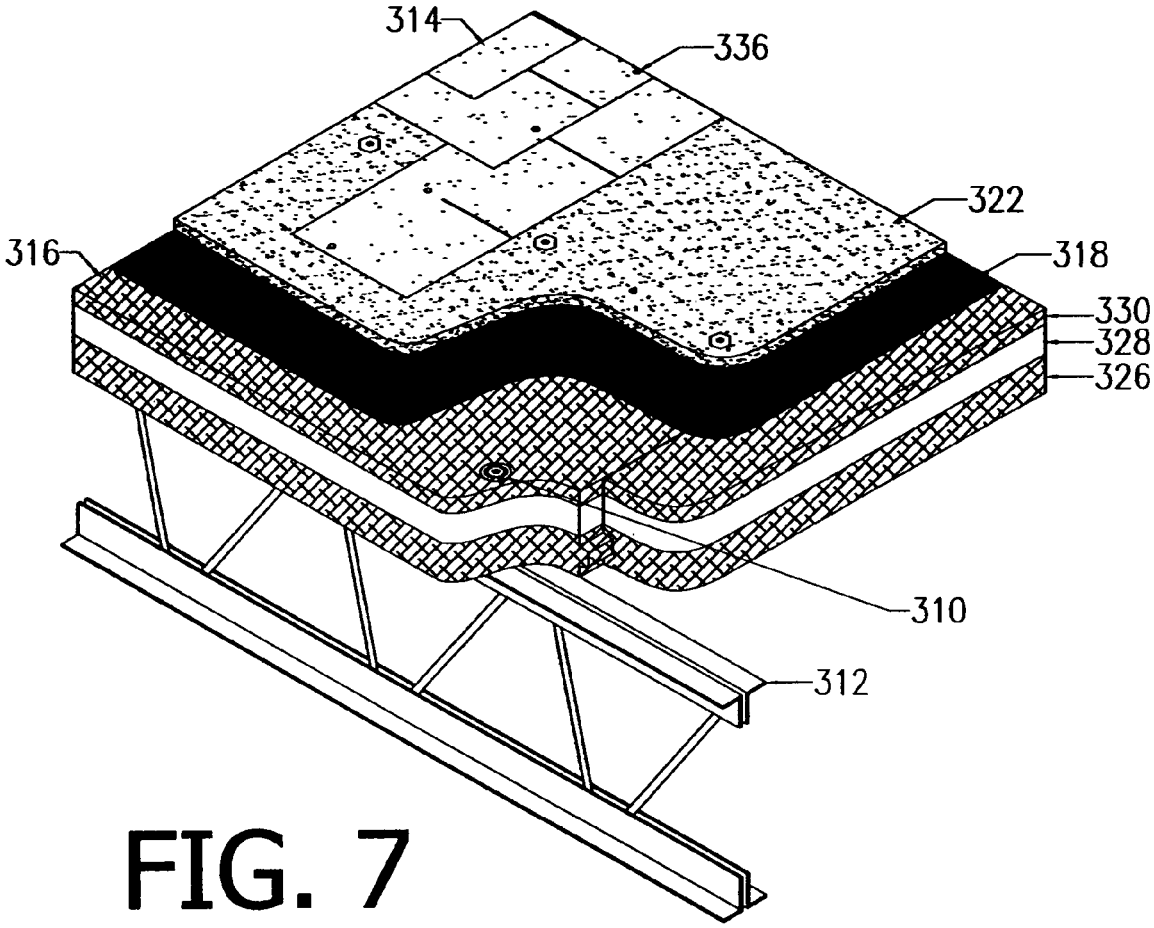
FIG. 7 is a perspective view of a fourth embodiment of the system shown in FIG. 1, showing the single mineral board layer resting directly on the red rosin paper.
Figure 8:
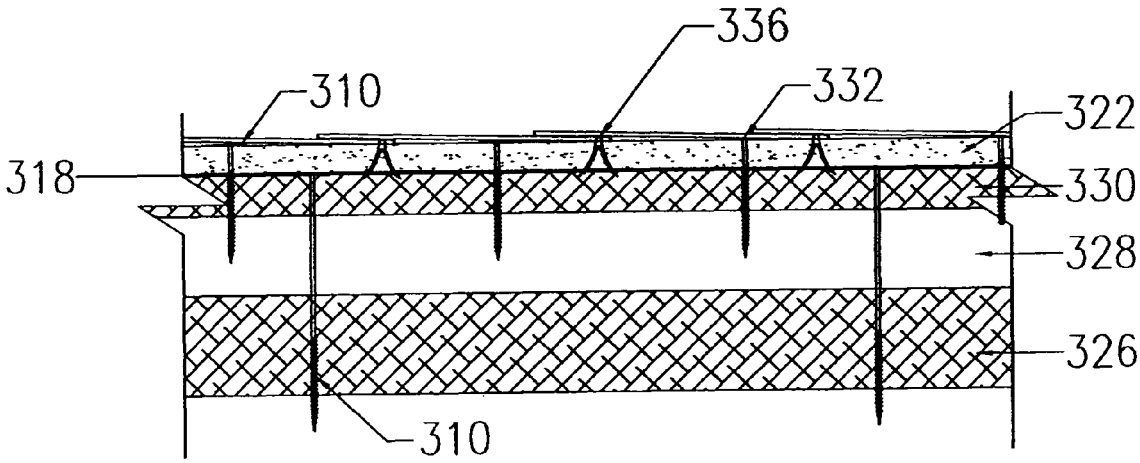
FIG. 8 is a cross sectional view of the system shown in FIG. 7.

A third alternate embodiment of a roof deck system 310 is shown in FIGS. 7 and 8 in a substantially similar environment to include a similar base panel 316 surmounted by a substantially water resistant membrane 318 as previously described, and a single mineral board layer 322. The base panel 316 if formed by layers 326, 328, and 330, similar to layers 26, 28, and 30 of the base panel of the roof deck system 10. The roof deck system 310 is supported by roof support members 312, in a manner similar to the roof deck system 10. The mineral board layer 322 rests directly on the red rosin paper 318 and serves as a surface for receiving the overlapping singles 336 that make up the roofing membrane 314. The mineral board layer 322 is secured to the base panel 316 by mineral board screws 332, similar to the screws 32 of the roof deck system 10.

The resulting roof deck systems previously describe are particularly suitable for installation in long span applications to provide a quiet roof. Advantageously, the roof deck systems 10, 100, 200 and 300 provide sufficient support without the need for a steel decking substrate and they permit installation of a conventional composition roof directly over the roof deck, without the need for any special venting system to preserve the wood components.

It is to be understood that while certain forms of the present invention have been illustrated and described herein, it is not to be limited to the specific forms or arrangement of parts described and shown.

Having described the preferred embodiments of the present invention, the following is claimed as new and desired to be secured by Letters Patent:

1. A low noise roof deck system for supporting a composite shingle roof and for installation without a metal deck on a roof support member and comprising:

a. a composite base panel, the base panel having a lower first layer including wood fibers bonded with a noncombustible mineral cement, a middle second layer bonded to said first layer and including an insulation material, and an upper third layer bonded to said second layer and including a resin bonded wood product having a nailable surface;

b. said base panel being adapted to be secured to the roof support member;

c. a mineral board panel secured to the nailable surface in overlying relation to said base panel;

d. said composite base panel and said mineral board panel being configured to support a composite shingle roof without thermal expansion or contraction noise associated with a metal deck and without venting; and e. a layer of a substantially water resistant material disposed between said composite base panel and said mineral board panel.

2. The low noise roof deck system as set forth in claim 1, further including a plurality of fasteners for securing said composite base panel to the roof support member and for securing said mineral board panel in overlying relation to said base panel.

3. The low noise roof deck system as set forth in claim 1, wherein said noncombustible mineral cement includes a component selected from the group consisting of magnesium oxide, magnesium sulfate, magnesium oxysulfate, sodium silicate and calcium carbonate.

4. The low noise roof deck system as set forth in claim 1, wherein said base panel first layer is selected from the group consisting of oriented strand board and chipboard.

5. The low noise roof deck system as set forth in claim 1, wherein said insulation material includes a foam synthetic resin material.

6. The low noise roof deck system as set forth in claim 5, wherein said foam synthetic resin material includes expanded polystyrene.

7. The low noise roof deck system as set forth in claim 6, further including a second mineral board panel disposed in overlying relation to said mineral board panel.

8. The low noise roof deck system as set forth in claim 1, wherein said resin bonded wood product comprises oriented strand board.

9. The low noise roof deck system as set forth in claim 1, wherein said substantially water resistant material is selected from the group consisting of felt paper and rosin paper.

10. The low noise roof deck system as set forth in claim 1, further including a layer of a second insulation material disposed between said substantially water resistant material and said mineral board panel.

11. The low noise roof deck system as set forth in claim 1, further including a layer of composite shingles positioned in overlying relation to said mineral board layer and forming a waterproof roofing membrane without venting.

12. A low noise roof system for installation without a metal deck and comprising:

a. a roof deck system having a first composite panel, the panel having: a lower first layer including wood fibers bonded with an inorganic cement, a middle second layer bonded to said first layer and including a foam synthetic resin insulation, and an upper third layer bonded to said second layer and including a resin bonded wood product having a nailable surface; a layer of a second foam synthetic resin insulation disposed in overlying relation to said first composite panel; and a mineral board panel secured to the nailable surface in overlying relation to said layer of second insulation material; said first composite panel and said mineral board being configured to support a composite shingle roof without a metal deck;

b. a plurality of composite shingles secured in overlying relation to said mineral board panel and forming a roofing membrane without venting; and c. a layer of a substantially water resistant material disposed between said first composite panel and said mineral board.

13. The low noise roof system set forth in claim 12, wherein said inorganic cement includes a component selected from the group consisting of magnesium oxide, magnesium sulfate, magnesium oxysulfate, sodium silicate and calcium carbonate.

14. The low noise roof system set forth in claim 12, wherein said mineral board panel is a first mineral board panel, and including a second mineral board panel disposed in overlying relation to said first mineral board panel.

15. The low noise roof system as set forth in claim 14, further including a plurality of fasteners for securing said first composite panel to the roof support member and for securing said first and second mineral board panels and said second layer in overlying relation to said first composite panel.

16. In a method for installing a low noise roof deck without a metal deck on a roof support member, the improvement including the steps of:

a. installing a composite base panel, the base panel having a lower first layer including wood fibers bonded with an inorganic cement, a middle second layer including a foam synthetic resin insulation material bonded to said first layer, and an upper third layer bonded to said second layer and including a resin bonded wood product, by securing said base panel to the roof support member using a plurality of fasteners;

b. next installing a layer of a substantially water resistant material in overlying relation to said composite base panel;

c. next installing a layer of a second foam synthetic resin insulation material in overlying relation to said layer of substantially water resistant material;

d. next installing a mineral board panel in overlying relation to said layer of the second foam synthetic resin insulation material using a plurality of fasteners that extend downwardly into said composite base panel; and e. next installing a plurality of composite shingles secured in overlying relation to said mineral board panel and forming a roofing membrane without venting.

17. The method for installing a roof deck as set forth in claim 16, including the step of:

a. installing a second mineral board panel disposed in overlying relation to said mineral board panel.

18. The method for installing a roof deck as set forth in claim 17, including the step of:

a. installing said layer of composite shingles positioned in overlying relation to said second mineral board panel and forming a waterproof roofing membrane.

* * * * *